US007243921B2

(12) United States Patent
Larson et al.

(10) Patent No.: US 7,243,921 B2
(45) Date of Patent: Jul. 17, 2007

(54) METHOD PROVIDING SELF-DISPENSING ADDITIVE FROM BUFFER BLOCKS FOR USE WITH A MEDIUM IN A BULLET TRAP

(75) Inventors: Steven L. Larson, Vicksburg, MS (US); Charles A. Weiss, Jr., Clinton, MS (US); Joe G. Tom, Vicksburg, MS (US); Philip G. Malone, Vicksburg, MS (US); Edward J. Fransen, Irvine, CA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/484,558

(22) Filed: Jul. 12, 2006

(65) Prior Publication Data

US 2007/0126184 A1 Jun. 7, 2007

Related U.S. Application Data

(60) Division of application No. 10/911,771, filed on Aug. 4, 2004, now Pat. No. 7,111,847, which is a continuation-in-part of application No. 10/307,427, filed on Dec. 2, 2002, now Pat. No. 6,837,496.

(51) Int. Cl.
*F41J 1/12* (2006.01)

(52) U.S. Cl. ..... 273/410

(58) Field of Classification Search ..... 273/404–410; 106/679; 428/76, 312.4; 264/42; 451/359
See application file for complete search history.

(56) References Cited

U.S. PATENT DOCUMENTS

| | | | |
|---|---|---|---|
| 4,057,608 | A | 11/1977 | Hashimoto et al. |
| 4,113,913 | A | 9/1978 | Smiley |
| 4,706,416 | A | 11/1987 | Kottas |
| 5,435,571 | A | 7/1995 | Wojcinski et al. |
| 5,607,163 | A | 3/1997 | Nesler |
| 5,848,794 | A | 12/1998 | Wojcinski et al. |
| 5,901,960 | A | 5/1999 | Nesler et al. |
| 5,942,306 | A | 8/1999 | Tom et al. |
| 6,000,700 | A | 12/1999 | Nesler et al. |
| 6,027,120 | A | 2/2000 | Wojcinski et al. |
| 6,173,956 | B1 | 1/2001 | O'Neal |
| 6,264,735 | B1 | 7/2001 | Bean et al. |
| 6,293,552 | B1 | 9/2001 | Wojcinski et al. |
| 6,378,870 | B1 | 4/2002 | Sovine |
| 6,446,974 | B1 | 9/2002 | Malone et al. |
| 6,485,561 | B1 | 11/2002 | Dattel |
| 6,573,358 | B2 | 6/2003 | Michels et al. |
| 6,620,236 | B2 | 9/2003 | Huntsman et al. |
| 6,688,811 | B2 | 2/2004 | Forrester |
| 6,837,496 | B2 | 1/2005 | Larson et al. |
| 2005/0006849 | A1 | 1/2005 | Larson et al. |

FOREIGN PATENT DOCUMENTS

| | | |
|---|---|---|
| WO | WO 91/17408 | 11/1991 |

*Primary Examiner*—Mark S. Graham
(74) *Attorney, Agent, or Firm*—Earl H Baugher, Jr.

(57) ABSTRACT

A method providing a self-dispensing additive for buffering a projectile trapping medium and passivating spent projectiles trapped therein. The additive is a buffering compound formed as blocks of low-density foamed-concrete that self-dispenses the additive when contacted by the fired projectiles. The blocks contain dry components that may include one or more of low-solubility phosphate compounds, low-solubility aluminum compounds, iron compounds, sulfate compounds, and calcium carbonate mixed with a cementing material, water, and an aqueous-based foam in substantially stoichiometric amounts. The aqueous-based foam is added in a quantity sufficient to adjust the density of the block to neutral buoyancy in the projectile-trapping medium. The additive chemically stabilizes the medium while also passivating projectiles, in particular heavy-metal projectiles, trapped in the medium.

9 Claims, No Drawings

METHOD PROVIDING SELF-DISPENSING ADDITIVE FROM BUFFER BLOCKS FOR USE WITH A MEDIUM IN A BULLET TRAP

RELATED APPLICATIONS

This application is a division of U.S. Ser. No. 10/911,771 filed on Aug. 4, 2004 U.S. Pat. No. 7,111,847, Self-Dispensing Bullet Trap Buffer Block, issued to Larson et al., Sep. 26, 2006, which is a continuation-in-part of U.S. Ser. No. 10/307,427 filed on Dec. 2, 2002 U.S. Pat. No. 6,837,496 B2, Bullet Trapping Medium and System, issued to Larson et al., Jan. 4, 2005, each of which is incorporated herein by reference.

STATEMENT OF GOVERNMENT INTEREST

Under paragraph 1(a) of Executive Order 10096, the conditions under which this invention was made entitle the Government of the United States, as represented by the Secretary of the Army, to the entire right, title and interest therein of any patent granted thereon by the United States. This patent and related ones are available for licensing. Contact Phillip Stewart at 601 634-4113.

BACKGROUND OF THE INVENTION

In order to maintain proficiency in the use of firearms, it is common to engage in target practice on a training range. Traditionally, the primary concern on a training range has been the prevention of ricochets. Thus, ranges often use a large dirt berm behind the target to decelerate and trap the bullet.

In addition to preventing ricochets, considerable concern has recently been raised about the environmental impact of heavy metals (e.g., lead, tungsten, copper) contained within the bullet. Though a bullet fired into a mound of dirt is safe insofar as it is no longer a dangerous projectile, heavy metals within the bullet remain free to leach into the soil, thereby contaminating the environment. Thus, shooting ranges have begun to stress containment and removal of expended rounds in order to minimize environmental contamination.

Thus, current trends in bullet containment systems focus on two different types of systems. The first, often called a bullet stop and containment chamber, has a pair of plates that channel bullets toward an opening in a containment chamber. Inside the containment chamber are impact plates that slow the bullet to a stop. Rounds may then be reclaimed from the containment chamber. Unfortunately, such systems are relatively expensive and difficult to manufacture and maintain.

The second type of containment system is the bullet backstop or bullet trap system. Bullet backstops typically include a back plate made of steel inclined to the line of fire. On an upper surface of the back plate, a layer of material is disposed to provide a medium for decelerating and trapping bullets. This layer is several feet thick in the direction the bullet travels. The impact material is typically a resilient granular material. As a bullet impacts the material, it will decelerate sufficiently such that, if it does impact the back plate, any ricochet will be minimal. Rounds may periodically be mined from the impact material.

A number of bullet traps utilize rubber chunks or chips as the impact material. For example, U.S. Pat. No. 6,378,870 to Sovine ("the '870 patent") teaches the use of relatively large rubber nuggets disposed along a plane inclined to the line of fire, while U.S. Pat. No. 5,848,794 to Wojcinski et al. ("the '794 patent") discloses a similar bullet trap using relatively small rubber granules disposed along an inclined plane.

Though these systems trap the bullet and reduce impact hazards, they generally do nothing to stabilize them from an environmental standpoint while they remain in the trap. While some extant systems teach the use of stabilizing or passivating additives to minimize environmental hazards, they generally teach the use of powdered or granular additives. For example, U.S. Pat. No. 6,688,811 to Forrester ("the '811 patent") teaches the use of a granular additive that is essentially a slow-release phosphate fertilizer added to the projectile impact area as suggested by the Environmental Protection Agency (EPA). These granular and powdered additives have a tendency to settle as the trap is vibrated by incoming fire or wash out when the trap is wetted. Either event has a deleterious effect on the concentration and distribution of buffering compound within the trap. Thus, there remains a need to either periodically replenish the additives or recover expended rounds from the bullet traps to prevent heavy metal leaching and associated environmental contamination.

DETAILED SPECIFICATION

A method for forming an additive for stabilizing and passivating (herein collectively referred to as buffering) a projectile trapping medium (e.g., a resilient granular ballistic medium) and spent projectiles trapped therein. (It should be understood that the terms "bullet," "projectile," and "round" are used interchangeably herein and refer to projectiles or munitions of any sort or caliber.) In select embodiments of the present invention, the additive is a buffering compound formed as a weakly-cemented, low-density block. Such a weakly-cemented block will self-dispense via fragmentation or pulverization when struck by incoming rounds, thereby increasing the concentration and distribution of the buffering compound in the projectile trapping medium.

In select embodiments of the present invention, a low density, self-dispensing, foamed-concrete block combines one or more dry components, selected from the group consisting of low solubility phosphate compounds, low solubility aluminum compounds, iron compounds, sulfate compounds, and calcium carbonate, with a cementing material, water, and an aqueous based foam. In select embodiments of the present invention, the cementing material, which acts as a binder, is preferably either portland cement or gypsum cement, though one skilled in the art will recognize that other cementitious materials (e.g., alundum cement) may be used without departing from the scope of the invention. One skilled in the art will recognize that the dry components, cementitious material, and water must be provided in approximately stoichiometric amounts.

In select embodiments of the present invention, the aqueous-based foam is added in a quantity sufficient to adjust the density of the resulting block to be sufficiently high to be non-buoyant, such that it will not float off the top of the projectile trapping medium during rains, yet sufficiently low to prevent the block from sinking in the projectile-trapping medium. In essence, the density of the resulting block should approximately match the density of the projectile-trapping medium. Preferably, in select embodiments of the present invention, the aqueous-based foam is added in a quantity sufficient to yield a density between about 65 and 90 $lb/ft^3$. Cement-based materials in this density range typically have an unconfined compressive strength of less than 1000 $lb/in^2$. Thus, they will not produce ricochets when struck by incoming bullets. Rather, incoming bullets will break or grind the buffer blocks into fine particles that may react with any moisture or heavy metals in the projectile trapping medium, continuously replenishing the amount of buffering compound in the trapping medium. Larger fragments of the blocks, which are preferably substantially circular cylindrical with a diameter of between about 2.5 and 15 cm (one and six inches), will not readily dissolve, thereby reducing washout and ensuring a ready and relatively consistent supply of buffering compound. To further minimize the risk of ricochets, any cement lumps or pebbles in the block should be less than 1 cm (⅜ inch) in diameter.

In select embodiments of the present invention, the low solubility phosphate compounds are preferably selected from the group consisting of mono-, di-, and tri-basic calcium and magnesium phosphate, zinc phosphate, aluminum phosphate, and any combination thereof. In select embodiments of the present invention, the preferred low solubility aluminum compounds are from the group consisting of aluminum phosphate, aluminum metaphosphate, aluminum silicate, aluminum hydroxide, and any combination thereof. In select embodiments of the present invention, the preferred iron compounds come from the group consisting of iron oxide, iron phosphate, iron silicate, calcium iron carbonate, and any combination thereof. In select embodiments of the present invention, the preferred sulfate compounds are selected from the group consisting of calcium sulfate, iron sulfate, potassium aluminum sulfate hydrate, and any combination thereof. However, other phosphate, aluminum, iron, and sulfate compounds may be employed without departing from the scope of the present invention.

Once the self-dispensing blocks are fragmented, the buffering compound reacts with lead contained in spent rounds to form a compound that immobilizes (that is, environmentally stabilizes) the lead. The preferred compositions of buffering compound may be described by the lead compound they are capable of producing: pyromorphite ($Pb_5(PO_4)_3Cl$), plumbogummite ($PbAl_3(PO_4)_2OH_5.H_2O$), and corkite ($PbFe_3(PO_4)(SO_4)(OH)_6$). One skilled in the art will recognize that the pyromorphite additive requires a phosphate-based buffering compound, that the plumbogummite additive requires a phosphate- and aluminum-based buffering compound, and that the corkite additive requires the presence of calcium phosphate, iron, and sulfate in the buffering compound.

In select embodiments of the present invention, generally, the pyromorphite buffering compound includes about 1 part by mass of a low solubility phosphate compound, about 1 part by mass of cementing material, and about 0.4 parts by mass of water. In select embodiments of the present invention, the plumbogummite buffering compound also includes about 0.7 parts by mass of a low solubility aluminum compound, while the corkite buffering compound also includes about 1.4 parts by mass of an iron compound and about 1 part by mass of a sulfate compound. Tables 1 through 4 present more specific illustrative formulations of these three preferred buffering compounds, though other formulations of the preferred compositions are regarded as within the scope of the present invention.

TABLE 1

| PYROMORPHITE BUFFER | |
|---|---|
| Tribasic Calcium Phosphate | 100 g |
| Calcium Carbonate | 100 g |
| Portland Cement (Type I-II) | 100 g |
| Water (sufficient to make a workable paste) | Approx. 200 g |
| Foam (to reduce density of mixture as desired) | Approx. 1,280 g/l |

TABLE 2

| PLUMBOGUMMITE BUFFER | |
|---|---|
| Tribasic Calcium Phosphate | 100 g |
| Aluminum Hydroxide (Gel Dried) | 70 g |
| Portland Cement (Type I-II) | 100 g |
| Water (sufficient to make a workable paste) | Approx. 300 g |
| Foam (to reduce density of mixture as desired) | Approx. 1,280 g/l |

TABLE 3

| CORKITE BUFFER | |
|---|---|
| Tribasic Calcium Phosphate | 50 g |
| Calcium Sulfate, Anhydrous | 20 g |
| Ferric Oxide, Anhydrous | 70 g |
| Portland Cement (Type I-II) | 50 g |
| Water (sufficient to make a workable paste) | Approx. 180 g |
| Foam (to reduce density of mixture as desired) | Approx. 1,280 g/l |

TABLE 4

| CORKITE-GYPSUM BUFFER | |
|---|---|
| Tribasic Calcium Phosphate | 50 g |
| Calcium Sulfate, Anhydrous | 20 g |
| Ferric Oxide, Anhydrous | 70 g |
| Portland Cement (Type I-II) | 50 g |
| Plaster (calcium sulfate hemihydrate) | 50 g |
| Water (sufficient to make a workable paste) | Approx. 230 g |
| Foam to reduce density of mixture | Approx. 1,280 g/l |

In select embodiments of the present invention, to form the additive, appropriate dry components and a cementing material are selected and mixed with water in substantially stoichiometric amounts to make a workable paste. One skilled in the art will recognize that additional small amounts of water may be required to increase the flowability of the paste. A quantity of aqueous-based foam, sufficient to yield the desired density of the resultant additive block, is added to the paste to form a slurry. In select embodiments of the present invention, the slurry is then cast in a mold, preferably using the standard protocols for preparing foamed concrete or foamed mortar, and cured to yield a low density, self-dispensing, foamed concrete block of buffering compound.

In select embodiments of the present invention, the resulting block of buffering compound may be employed in a projectile-trapping medium to passivate and stabilize the medium and spent projectiles trapped therein. One or more such blocks are placed in contact with the projectile-trapping medium, for example by mixing the blocks into the projectile-trapping medium or preferably by disposing the blocks over some or all of the upper surface of the projectile-trapping medium. The projectile-trapping medium, and therefore the blocks, are subjected to incoming fire, which pulverizes the blocks into small fragments capable of reacting with heavy metals present in spent projectiles to form a passive coating on the spent projectiles. This, in turn, prevents leaching of heavy metals into the environment. As noted above, buffering compounds introduced as self-dispensing blocks remain in the projectile-trapping medium over a longer period of time than the simple application of a particulate or granular solid, and additional incoming fire merely increases the amount of buffering compound available for reaction. However, in select embodiments of the present invention, additional blocks may be added to the projectile trapping medium as necessary in order to ensure a continuous supply of buffering compound.

In testing select embodiments of the present invention, two-gram samples of technical grade lead powder were added to each of the buffering compounds illustrated in Tables 1 through 4 to produce a mixture of 1% lead on a dry weight basis. The lead was ground into the buffering compound using a mortar and pestle to ensure a homogenous mixture. A control sample was prepared by mixing 2 grams of lead with sufficient quartz sand to make a 200 gram sample. All samples were moistened to 40 to 50% moisture with distilled water and allowed to age for approximately 36 days at room temperature in a closed container. The samples were then submitted for testing using the Toxic Characteristics Leaching Procedure (TCLP), and the amount of lead in each TCLP extract was determined using standard analytical procedures (EPA Method 200.7). Table 5 summarizes the results.

TABLE 5

LEAD CONCENTRATION IN TCLP LEACHATE

| Buffer | Lead Concentration (ppm) |
|---|---|
| Pyromorphite | 50.8 |
| Plumbogummite | 0.35 |
| Corkite | 11.5 |
| Corkite-Gypsum | 26.4 |
| Control Sample | 279 |

Additives according to the present invention are well suited for use in a projectile trapping medium that combines a resilient granular ballistic medium (e.g., rubber chunks, wood chips, plastic scrap) with a hydrated super absorbent polymer (SAP) gel to form an "artificial soil" of ballistic medium "chunks" in an SAP gel matrix. Such cross-linked polyacrylate and polyamide SAP gels are most stable when maintained in a wet condition with a pH above 4.5, as they tend to shrink and shed water in acids. Higher alkalinities also reduce the solubility of lead and other heavy metal ions. The buffering compounds of select embodiments of the present invention not only passivate heavy metals in spent projectiles, but also chemically stabilize the SAP gel by maintaining the pH of the projectile trapping medium between about 8 and 10.5, inclusive. Table 6 summarizes the pH of water suspensions of the buffers presented in Tables 1-4.

TABLE 6 pH of WATER/BUFFER SUSPENSIONS

| | |
|---|---|
| Pyromorphite | pH 10.5 |
| Plumbogummite | pH 10.0 |
| Corkite | pH 10.5 |
| Corkite-Gypsum | pH 8.5 |

While the invention has been described in terms of its preferred embodiments, those skilled in the art will recognize that the invention can be practiced with modifications within the spirit and scope of the appended claims. For example, though the invention is well suited to use in a projectile trapping medium containing hydrated SAP gel, use in any type of bullet trapping medium or trap (e.g., soil berms, sand traps, and metal traps) is regarded as within the scope of the present invention. Thus, it is intended that all matter contained in the foregoing description shall be interpreted as illustrative rather than limiting, and the invention should be defined only in accordance with the following claims and their equivalents.

We claim:

1. A method of providing an additive in a self-dispensing form for stabilizing a projectile-trapping medium and passivating spent projectiles trapped therein, comprising:

selecting at least one dry component from the group consisting of low-solubility phosphate compounds, low-solubility aluminum compounds, iron compounds, sulfate compounds, and calcium carbonate;

selecting at least one cementing material;

providing water;

mixing substantially stoichiometric amounts of said dry components, said cementing material, and said water to yield a workable paste;

wherein said mixing substantially stoichiometric amounts of said dry components, said cementing material, and said water comprises mixing about one part by mass said low-solubility phosphate compound, about one part by mass said cementing material, and about 0.4 parts by mass said water;

adding a quantity of an aqueous-based foam to said paste to form a slurry, wherein the quantity of said foam is sufficient to yield a density of said additive sufficiently high to prevent buoyancy of said additive and sufficiently low to prevent said additive from sinking in said projectile-trapping medium;

casting said slurry in at least one mold suitable to establish said form;

at least partially curing said slurry in said mold; and removing said cured slurry from said mold to yield said self-dispensing form.

2. The method of claim 1 in which said mixing substantially stoichiometric amounts of said dry components, said cementing material, and said water comprises mixing about 1 part by mass said low-solubility phosphate compound, about 0.7 parts by mass said low-solubility aluminum compound, about 1 part by mass said cementing material, and about 0.4 parts by mass said water.

3. The method of claim 1 in which said mixing substantially stoichiometric amounts of said dry components, said cementing material, and said water comprises mixing about 1 part by mass low-solubility phosphate compound, about 1.4 parts by mass iron compound, about 1 part by mass sulfate compound, about 1 part by mass cementing material, and about 0.4 parts by mass water.

4. The method of claim 1 further comprising adding said low-density, self-dispensing, foamed-concrete block to a projectile trapping medium.

5. A method of dispensing compounds for stabilizing a projectile-trapping medium and passivating spent projectiles trapped therein, comprising:

adding to said projectile-trapping medium low-density, self-dispensing, foamed-concrete blocks of buffering compound; and contacting said blocks with fired projectiles;

wherein said contacting with fired projectiles at least in part disintegrates said blocks and distributes said buffering compound throughout said medium for intimate contact with said spent projectiles.

6. The method of claim 5 adding said blocks comprising mixing said blocks within said projectile-trapping medium.

7. The method of claim 5 adding said blocks by disposing at least some of said blocks over at least a portion of an upper surface of said projectile-trapping medium.

8. The method of claim 7 establishing the density of said blocks such that said blocks are neutrally buoyant in said projectile-trapping medium.

9. The method of claim 7 said blocks comprising:

one or more dry components from the group consisting of low-solubility phosphate compounds, low-solubility aluminum compounds, iron compounds, sulfate compounds, and calcium carbonate;

a cementing material;

water; and a quantity of aqueous-based foam sufficient to yield a density of said blocks between about 65 and 90 $lb/ft^3$;

wherein said one or more dry components, said cementing material, and said water are provided in substantially stoichiometric amounts.

* * * * *